US007131314B2

(12) United States Patent
Yoshida et al.

(10) Patent No.: US 7,131,314 B2
(45) Date of Patent: Nov. 7, 2006

(54) MATERIAL FOR DIAMOND SINTERED BODY DIE AND DIAMOND SINTERED BODY DIE

(75) Inventors: Minoru Yoshida, Itami (JP); Takeru Nakashima, Itami (JP); Tadashi Yamaguchi, Itami (JP)

(73) Assignee: Sumitomo Electric Hardmetal Corp., Hyogo (JP)

( * ) Notice: Subject to any disclaimer, the term of this patent is extended or adjusted under 35 U.S.C. 154(b) by 0 days.

(21) Appl. No.: 10/497,084

(22) PCT Filed: May 23, 2003

(86) PCT No.: PCT/JP03/06493

§ 371 (c)(1),
(2), (4) Date: May 28, 2004

(87) PCT Pub. No.: WO03/101638

PCT Pub. Date: Dec. 11, 2003

(65) Prior Publication Data

US 2005/0076897 A1 Apr. 14, 2005

(30) Foreign Application Priority Data

May 31, 2002 (JP) ..... 2002-158400

(51) Int. Cl.
*B21C 3/02* (2006.01)

(52) U.S. Cl. ..... 72/467; 423/446

(58) Field of Classification Search ..... 72/461, 72/467; 423/446

See application file for complete search history.

(56) References Cited

U.S. PATENT DOCUMENTS 1,438,940 A 12/1922 Blount
1,624,027 A * 4/1927 Vollmer ..... 72/467
3,831,428 A * 8/1974 Wentorf et al. ..... 72/467
4,241,625 A * 12/1980 Corbin et al. ..... 76/107.4
4,260,397 A * 4/1981 Bovenkerk ..... 51/307
4,797,326 A * 1/1989 Csillag ..... 428/552
5,957,005 A 9/1999 Einset et al.

FOREIGN PATENT DOCUMENTS

| | | |
|---|---|---|
| CN | 86 1 08742 A | 7/1988 |
| DE | 697 363 C | 10/1940 |
| EP | 0 175 497 | 3/1986 |
| EP | 0 909 595 A2 | 4/1999 |
| FR | 876 118 A | 10/1942 |
| JP | 6-134517 | 5/1994 |

* cited by examiner

*Primary Examiner*—Daniel C. Crane
(74) *Attorney, Agent, or Firm*—McDermott Will & Emery LLP

(57) ABSTRACT

To provide a diamond compact die semi-manufactured product and a diamond compact die that do not crack during die processing.

A diamond compact die semi-manufactured product includes a diamond compact and a holding ring. The holding ring is a cylinder composed of a tungsten alloy, and the inner diameter thereof is tapered. The diamond compact is tapered so as to fit to the taper of the cylinder and the diamond compact is press-fitted to the holding ring. For lower cost production, the tapered face of the diamond compact is formed by electric spark machining. The tungsten alloy contains 90% to 97% by weight of tungsten and 3% to 10% by weight of nickel.

18 Claims, 2 Drawing Sheets

MATERIAL FOR DIAMOND SINTERED BODY DIE AND DIAMOND SINTERED BODY DIE

FIELD OF THE INVENTION

The present invention relates to diamond compact dies used in drawing of a variety of wires, such as metal wires and stainless steel wires, and pipes and to diamond compact die semi-manufactured products.

DESCRIPTION OF THE RELATED ART

Natural diamond, artificial monocrystalline diamond, and diamond compacts are known for drawing wires and pipes. The diamond compacts are categorized into a diamond compact surrounded by a cemented carbide reinforcing holding ring and a diamond compact without a holding ring. In general, a diamond compact without a holding ring is used for a die having a small outer diameter of 6 mm or less.

The diamond compact without a holding ring is embedded into nickel and copper powder and these are sintered to form a die semi-manufactured product. The diamond compact in this process is metallurgically bonded to the metal powder compact. In general, the diamond compacts are embedded by die fabricators to fit their sizes to sizes of the die holders.

In contrast, a diamond compact having an outer diameter of 7 mm or more is generally provided with a holding ring. The holding ring is a reinforcement for preventing the expansion of the diamond compact during the wire drawing.

FIG. 2 shows a known diamond compact die having a die hole 4 in the center of a diamond compact die semi-manufactured product of a diamond compact 1 that is reinforced with a cemented carbide holding ring 2. Since the diamond compact is sintered at ultrahigh pressure and high temperature, it is metallurgically bonded to the cemented carbide.

In general, a preliminary hole is provided in the center of a diamond compact with a holding ring by electric spark machining and is polished to form a final product. In this process, perpendicular cracks are generated in the inner face of the die, resulting in the formation of a defective product. The yield is significantly low, i.e., 70% to 80%, and various attempts have been made to solve this problem. Unfortunately, this has not yet been solved and remains a well-known problem in this industrial field.

A conventional diamond compact die semi-manufactured product with a holding ring is prepared by sintering a mixture of diamond particles and a sintering material, and a cobalt flake binder, if necessary, in a cemented carbide casing at ultrahigh pressure and high temperature. Thus, the cemented carbide case and the diamond compact are metallurgically bonded at the ultrahigh pressure and high temperature. Since the cemented carbide has a thermal expansion coefficient larger than that of the diamond compact, the diamond compact has compressive residual stress across the diameter after cooling. This stress reinforces the diamond compact by cramping.

However, this thermal stress is also present across the height of the die. Since the holding ring shrinks across the height, tensile stress remains across the height of the hole provided in the center of the diamond compact. When the center of the diamond compact is perforated, perpendicular cracks are readily generated on the hole of the diamond compact. It is likely that these cracks are generated by the imbalance of stress after perforation, although no crack is generated before perforation.

Also in a diamond compact embedded into a nickel or copper powder compact, tensile stress occurs on the surface of the die hole.

The present invention is achieved for solving these known problems.

DISCLOSURE OF THE INVENTION

The present invention relates to a diamond compact die semi-manufactured product including a diamond compact and a holding ring, the holding ring being a cylinder composed of a tungsten alloy or a stainless steel alloy, the inner diameter thereof being tapered, the diamond compact being tapered so as to fit to the taper of the cylinder, the diamond compact being press-fitted to the holding ring, and to a die formed of the semi-manufactured product.

Preferably, the diamond compact has a diamond content in the range of 70% to 95% by volume. The tapered face of the diamond compact is formed by electric spark machining.

Preferably, the tungsten alloy comprises 90% to 98.2% by weight of tungsten and 1.8% to 10% by weight of nickel.

The nickel may be partly replaced with at least one element selected from the group consisting of copper, cobalt, and iron, wherein the contents of these elements in the tungsten alloy are as follows:

copper: 0% to 2.5% by weight
cobalt: 0% to 1.7% by weight
iron: 0% to 2.8% by weight More preferably, the nickel content is in the range of 1.8% to 7.5% by weight.

In the present invention, the diamond compact die semi-manufactured product is perforated in its center to form a diamond compact die. A face having a larger diameter diamond compact functions as a wire drawing inlet.

BEST MODE FOR CARRYING OUT THE INVENTION

Figure 3:
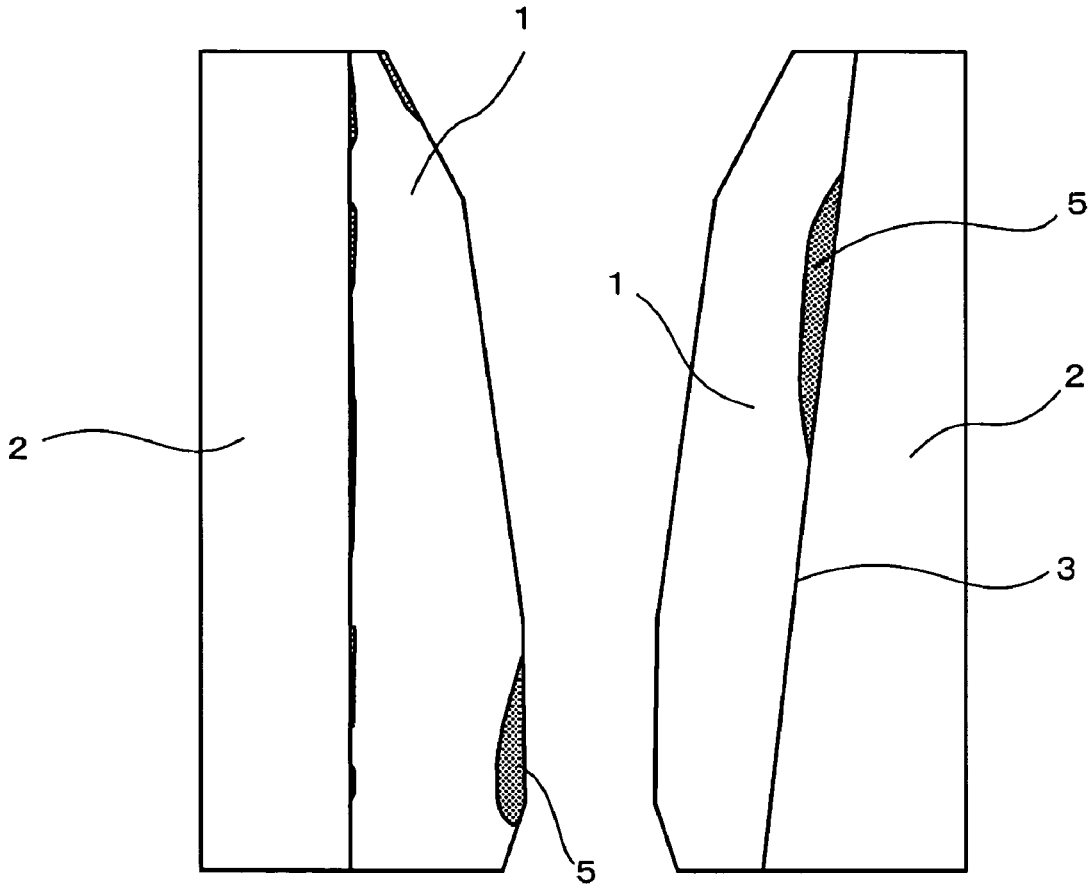
FIG. 3 is a schematic cross-sectional view showing a stress state. The left represents a conventional die, and the right represents the inventive die.

We searched for causes of the known problems. A diamond die compact bonded to conventional cemented carbide during sintering shrinks both across the diameter and the height when it is cooled to normal temperature. FIG. 3 is a cross-sectional view illustrating a stress of a diamond compact die, the stress being calculated by the finite element method. The drawing on the left in FIG. 3 represents the residual stress of a conventional die, while the drawing on the right represents the residual stress of a die according to the present invention. The shaded areas 5 in the drawings represent high tensile residual stress.

FIG. 3 shows that the tensile residual stress resides on the surface of a port of the wire drawing hole and the surface of the minimum diameter portion. When the die hole is processed, cracks will be generated perpendicularly to the hole at these portions with high probability.

The most important issue for solving the above problem is to form a structure in which the diamond compact and the holding ring are not metallurgically bonded to each other. A possible method is to shrink fit the diamond compact to a holding ring made of a metal such as tool steel to prevent metallurgically bonding. However, diamond compact dies prepared by this process cracked and were not used in practical wire drawing. This is probably due to insufficient clamping force.

For shrink fitting, the outer diameter of the diamond compact must be precisely finished. The diamond compact is difficult to process, and therefore it cannot be processed to a desired accuracy at low cost. This is a primary reason inhibiting practical use.

Figure 1:
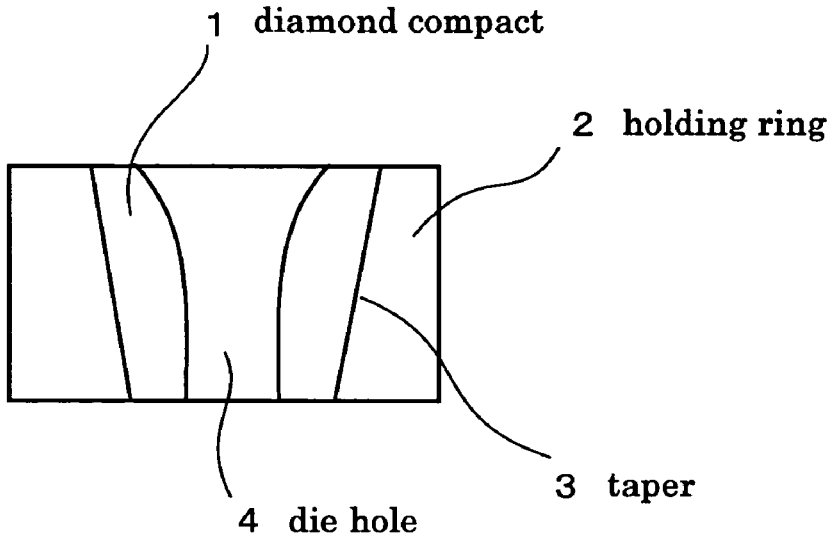
FIG. 1 is a cross-sectional view of a diamond compact die prepared in the present invention.
Figure 2:
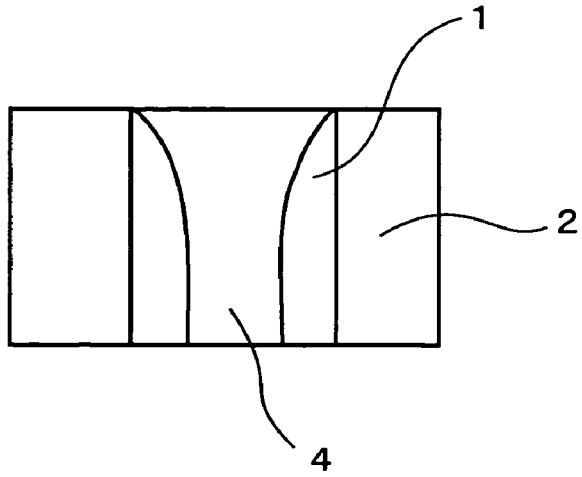
FIG. 2 shows a conventional die in which cemented carbide and a diamond compact are bonded to each other during sintering.

In the present invention, as shown in FIG. 1, a frusto-conical diamond compact 1 having a taper 3 is press-fit to a tapered holding ring 2 to ensure radial clamping force that counterworks radial outward force during wire drawing. Since the press-fit diamond compact 1 has small residual stress across the height, cracks are not generated during perforation. The diamond compact is not metallurgically bonded to the tungsten alloy of the holding ring.

The stress of the diamond compact die according to the present invention is shown on the left of FIG. 3. No residual stress resides on the surface of the die hole, thus preventing horizontal cracking during the formation of the die hole.

Materials for the holding ring surrounding the diamond compact 1 preferably have a high Young's modulus for high-clamping of the diamond compact. Cemented carbide is one candidate for such materials. However, cemented carbide contains tungsten carbide having high hardness; hence, it is a processing resistant material that significantly increases taper processing costs.

Accordingly, in the present invention, a tungsten alloy having high processability and a high Young's modulus may be used as described below. Preferably, the tungsten alloy contains 90% to 98.2% by weight of tungsten and 1.8% to 10% by weight of nickel. In addition, the nickel is partly replaced with at least one element selected from the group consisting of copper, cobalt, and iron, wherein the contents of these elements in the tungsten alloy are as follows:

copper: 0% to 2.5% by weight
cobalt: 0% to 1.7% by weight
iron: 0% to 2.8% by weight This alloy is used as a weight of a self-winding wristwatch and is readily processed irrespective of the tungsten-containing alloy. The tungsten-containing alloy has a small thermal expansion coefficient and thus does not cause a significant change in internal stress with the change in temperature from room temperature to 350° C. when it is used as a die.

In the present invention, the tungsten alloy may be replaced with a stainless steel. A preferable stainless steel sheet is a martensitic stainless steel having relatively high yield strength that reduces production costs when it is used as a die having a large diameter.

In the diamond compact according to the present invention, the diamond content is preferably in the range of 70% to 95% by volume. A content less than 70% by volume leads to poor abrasion resistance, whereas a content exceeding 95% by volume leads to low conductivity of the compact that inhibits electric spark machining.

The present invention is particularly effective for drawing a wire having a large diameter, but is not limited to a specific field. Preferably, the holding ring has an outer diameter of about 14.5 mm to 35 mm, and the diamond compact has an outer diameter of about 9 mm to 19 mm and a height of about 7.5 mm to 19 mm. If the outer diameter of the diamond compact is less than 9 mm, the compact is too inexpensive to apply the press fitting process according to the present invention. If the outer diameter exceeds 19 mm, the wire diameter is generally reduced by drawing rollers in industrial applications. However, a process using a die ensures high quality; hence, dies may be used in some applications even if the outer diameter exceeds 19 mm.

Diamond compacts without holding rings are prepared at a higher yield in one ultrahigh pressure, high temperature sintering process than diamond compacts with holding rings. Since the ultrahigh pressure, high temperature sintering process requires a large facility, the compact yield per process greatly affects the die costs. In the present invention, a disk diamond compact is milled into a truncated cone by electric spark machining, and the truncated cone is press-fit to a tapered holding ring to form a diamond compact die semi-manufactured product, thus ensuring high volume efficiency. In contrast, the conventional process by simultaneous sintering of the holding ring and the diamond compact shows low volume efficiency.

The present invention is also characterized in that the tapered face of the diamond compact, which is press-fit, is formed by electric spark machining. Since conventional electric spark machining conditions have poor processing accuracy, a fitting face to the holding component cannot be formed with high accuracy. The present inventors have investigated various electric spark machining conditions and discovered an electric spark machining condition with an accuracy of 0.01 mm.

On the surface of a conventional diamond compact formed by electric spark machining, a surface deteriorated layer with a thickness of several micrometers is formed, and this layer must be removed before press fitting. It is believed that polishing is essential for removing this layer. The present inventors have investigated various electric spark machining conditions and have succeeded in the largest possible reduction in thickness of the deteriorated layer by milling a diamond compact disk into a truncated cone and by processing the cone by electric spark machining at a reduced current.

The size of the taper is preferably in the range of 1/100 to 5/100. A taper size of less than 1/100 exhibits poor clamping force and does not show metallurgical bonding; hence, the diamond compact may pull out from the holding ring toward the drawing direction in the use of the die. A taper size exceeding 5/100 causes large friction during press fitting and may damage the diamond compact. More preferably, the taper size is in the range of 2/100 to 4/100.

EXAMPLE 1

In a ball mill, 90% to 92% by volume of diamond powder with a particle diameter of 5 μm to 25 μm and cobalt powder were mixed and pulverized. This powder was placed into a tungsten vessel, and the vessel was covered with a cobalt plate. The powder was sintered at 1500° C. and a pressure of 5 GPa. The tungsten vessel was removed from the surface of the compact by grinding to form a disk. A truncated cone with a diameter of 16 mm, a thickness of 16 mm, and a taper of 3/100 was formed by wire electric spark machining. After this process, the deteriorated layer formed by the electric spark machining and the unremoved portions were removed at a reduced current, where the unremoved portions indicated projections that are formed at the leading end and the trailing end of the electric spark machining. Ten diamond compact die semi-manufactured products were prepared in such a manner.

Also 95.4% by weight of tungsten powder, 3.05% by weight of nickel powder, and 1.55% by weight of iron powder were mixed and were sintered in a hydrogen atmosphere to prepare ten compacts with an outer diameter of 25 mm and a thickness of 16.5 mm.

These compacts were processed into an outer diameter of 24.13 mm, a minimum inner taper diameter of 16 mm, and a thickness of 16 mm. The processed inner diameter had a taper of 3/100.

Each resulting diamond compact was fitted to a holding ring, and these were pressed under a total load of 6 tons to form a diamond compact die semi-manufactured product. A total load of 3.5 tons was necessary for extracting the diamond compact from the inverted semi-manufactured product.

A die hole for drawing with a diameter of 6 mm was provided to each of the ten diamond compact die semi-manufactured products such that the maximum position of the taper of the diamond compact functioned as the inlet of a drawn wire. Copper pipes were successfully drawn through all the ten samples without generation of perpendicular cracks.

EXAMPLE 2

Ten holding rings were prepared as in EXAMPLE 1 except that the composition of the tungsten alloy was varied as shown in the Table below. Diamond compacts prepared as in EXAMPLE 1 were fitted to these holding rings to make ten dies. All the dies were nondefective products with no cracks in the holes.

TABLE

| Sample No. | Tungsten (%) | Nickel (%) | Copper (%) | Cobalt (%) | Iron (%) |
|---|---|---|---|---|---|
| 1 | 95 | 5 | | | |
| 2 | 95 | 3 | 0.7 | 0.6 | 0.7 |
| 3 | 96 | 3 | | 0.5 | 0.5 |
| 4 | 90 | 7 | 0.2 | | 2.8 |
| 5 | 90 | 3 | 2.5 | 1.7 | 2.8 |

% indicates % by weight.

INDUSTRIAL APPLICABILITY

As described above, the present invention provides a large die that is necessary for drawing a wire with a large diameter. Since the stress is well balanced, the die does not crack during the die processing. Conventional production exhibits an inevitable low yield. The yield is markedly improved in the present invention. Such a high yield facilitates production planning in factories.

The invention claimed is:

1. A diamond compact die semi-manufactured product comprising:

a diamond compact and a holding ring, the holding ring being a cylinder composed of a tungsten alloy or a stainless steel alloy, the inner diameter thereof being tapered, the diamond compact being tapered, so as to fit the taper of the cylinder, wherein the diamond compact is press-fitted into the holding ring without resorting to heating the holding ring, and the diamond compact and the holding ring do not undergo mutual metallurgical bonding.

2. The diamond compact die semi-manufactured product according to claim 1, wherein the diamond compact has a diamond content in the range of 70% to 95% by volume.

3. The diamond compact die semi-manufactured product according to either claim 1 or 2, wherein the tapered face of the diamond compact is formed by electric spark machining.

4. The diamond compact die semi-manufactured product according to claim 3, wherein the tungsten alloy comprises 90% to 98.2% by weight of tungsten and 1.8% to 10% by weight of nickel.

5. The diamond compact die semi-manufactured product according to claim 4, wherein the tungsten alloy comprises 90% to 98.2% by weight of tungsten, at least one element selected from the group consisting of copper, cobalt, and iron, and the balance consisting of nickel, wherein the contents of these elements in the tungsten alloy are as follows:

copper: 0% to 2.5% by weight cobalt: 0% to 1.7% by weight iron: 0% to 2.8% by weight.

6. The diamond compact die semi-manufactured product according to claim 1, wherein the tungsten alloy comprises 90% to 98.2% by weight of tungsten and 1.8% to 10% by weight of nickel.

7. The diamond compact die semi-manufactured product according to claim 2, wherein the tungsten alloy comprises 90% to 98.2% by weight of tungsten and 1.8% to 10% by weight of nickel.

8. The diamond compact die semi-manufactured product according to claim 1, wherein the taper size ranges from approximately 1/100 to approximately 5/100.

9. A diamond compact die comprising:

a diamond compact and a holding ring, the holding ring being a cylinder composed of a tungsten alloy, the inner diameter thereof being tapered, the diamond compact being tapered so as to fit to the taper of the cylinder, the diamond compact having a wire-drawing hole in its center, wherein the diamond compact is press-fit into the holding ring without resorting to heating the holding ring, and the diamond compact and the holding ring do not undergo mutual metallurgical bonding.

10. The diamond compact die according to claim 9, wherein a face having a larger diameter diamond compact functions as a wire drawing inlet.

11. The diamond compact die according to either claim 9 or 10, wherein the tapered face of the diamond compact is formed by electric spark machining.

12. The diamond compact die according to claim 11, wherein the tungsten alloy comprises 90% to 98.2% by weight of tungsten and 1.8% to 10% by weight of nickel.

13. The diamond compact die semi-manufactured product according to claim 12, wherein the tungsten alloy comprises 90% to 98.2% by weight of tungsten, at least one element selected from the group consisting of copper, cobalt, and iron, and the balance consisting of nickel, wherein the contents of these elements are as follows:

copper: 0% to 2.5% by weight cobalt: 0% to 1.7% by weight iron: 0% to 2.8% by weight.

14. The diamond compact die according to claim 9, wherein the tungsten alloy comprises 90% to 98.2% by weight of tungsten and 1.8% to 10% by weight of nickel.

15. The diamond compact die according to claim 10, wherein the tungsten alloy comprises 90% to 98.2% by weight of tungsten and 1.8% to 10% by weight of nickel.

16. The diamond compact die according to claim 11, wherein the tungsten alloy comprises 90% to 98.2% by weight of tungsten and 1.8% to 10% by weight of nickel.

17. The diamond compact die according to claim 9, wherein the taper size ranges from approximately 1/100 to approximately 5/100.

18. The diamond compact die according to claim 9, wherein the surface of the wire drawing hole is free of residual tensile strength in the axial direction of the holding ring.

* * * * *